US011772693B2

(12) United States Patent
Poesel

(10) Patent No.: US 11,772,693 B2
(45) Date of Patent: Oct. 3, 2023

(54) DEVICE FOR DETERMINING AT LEAST ONE MEASUREMENT VALUE RELATED TO A LOCATION AND/OR AT LEAST ONE MOVEMENT VARIABLE OF A TRACK-BOUND VEHICLE, AND METHOD FOR OPERATING SUCH A DEVICE

(71) Applicant: SIEMENS MOBILITY GMBH, Munich (DE)

(72) Inventor: Bernhard Poesel, Koenigslutter (DE)

(73) Assignee: Siemens Mobility GmbH, Munich (DE)

( * ) Notice: Subject to any disclaimer, the term of this patent is extended or adjusted under 35 U.S.C. 154(b) by 438 days.

(21) Appl. No.: 16/499,430

(22) PCT Filed: Mar. 1, 2018

(86) PCT No.: PCT/EP2018/055043
§ 371 (c)(1),
(2) Date: Sep. 30, 2019

(87) PCT Pub. No.: WO2018/177677
PCT Pub. Date: Oct. 4, 2018

(65) Prior Publication Data

US 2020/0023869 A1 Jan. 23, 2020

(30) Foreign Application Priority Data

Mar. 30, 2017 (DE) ..... 10 2017 205 456.5

(51) Int. Cl.
*B61L 25/02* (2006.01)

(52) U.S. Cl.
CPC ..... *B61L 25/025* (2013.01); *B61L 25/021* (2013.01); *B61L 25/026* (2013.01)

(58) Field of Classification Search
CPC ..... B61L 25/021; B61L 25/025; B61L 25/026
See application file for complete search history.

(56) References Cited

U.S. PATENT DOCUMENTS

| | | | | |
|---|---|---|---|---|
| 9,663,126 | B2 | 5/2017 | Orion | |
| 2014/0013291 | A1* | 1/2014 | Meers | G05B 9/02 716/111 |

FOREIGN PATENT DOCUMENTS

| | | | |
|---|---|---|---|
| CN | 102358334 | A | 2/2012 |
| CN | 104139789 | A | 11/2014 |
| CN | 105539522 | A | 5/2016 |
| DE | 102005046456 | A1 | 3/2007 |
| EP | 0881136 | A2 | 12/1998 |

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A device for determining at least one measurement value related to a location and/or one or more movement variables of a track-bound vehicle. The device is configured such that a safety integrity level can be specified for the device. The device additionally ascertains a confidence interval which depends on the respective specified safety integrity level in response to the measurement value or at least one of the measurement values. The device can be used in a flexible manner and at the same time reduces operational constraints due to imprecise measurement values and large confidence intervals connected thereto. There is also described a method for operating such a device.

15 Claims, 1 Drawing Sheet

(56) References Cited

FOREIGN PATENT DOCUMENTS

| | | | |
|---|---|---|---|
| EP | 1418109 | A1 | 5/2004 |
| WO | WO 2005095174 | A1 | 10/2005 |
| WO | WO 2013135533 | A1 | 9/2013 |

* cited by examiner

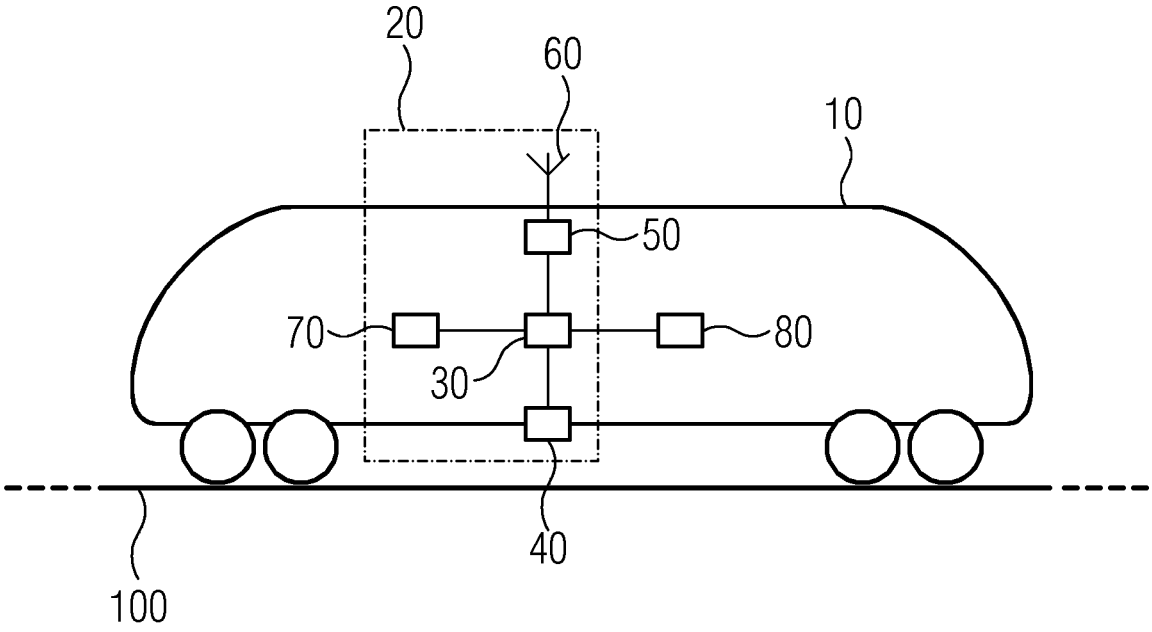
20
60
10
50
70
80
30
40
100

DEVICE FOR DETERMINING AT LEAST ONE MEASUREMENT VALUE RELATED TO A LOCATION AND/OR AT LEAST ONE MOVEMENT VARIABLE OF A TRACK-BOUND VEHICLE, AND METHOD FOR OPERATING SUCH A DEVICE

BACKGROUND OF THE INVENTION

Field of the Invention

The present invention relates to a device for determining at least one measurement value related to a location and/or at least one movement variable of a track-bound vehicle.

Modern train protection and control systems require accurate information in relation to the current location and/or in relation to current movement variables of the respective track-bound vehicle, for instance in the form of information relating to a distance traveled by the vehicle and a current speed. Typically, different redundant sensors are used for determining and providing this information. Examples of corresponding sensors may include wheel impulse generators, accelerometers, radar systems, balise systems or also satellite-based sensors or tracking systems, on the basis of GPS (Global Positioning System), for instance. By amalgamating the data of the various sensors, further data, also referred to as odometry data, is ascertained which, in addition to the respective distance and speed values, typically comprises associated confidence intervals. Said data represents a measure for the accuracy or inaccuracy of the respective measurement value, a greater uncertainty in the determination of the respective measurement variable or of the respective measurement value resulting in a greater confidence interval.

In practice, the situation can arise whereby the performance of a train protection or control system which uses the corresponding measurement values for controlling or protecting the respective track-bound vehicle is constrained due to the uncertainty expressed by the confidence interval in relation to the respective measurement value. This can lead in particular to the requirement for a reduction in the speed of the respective track-bound vehicle (or also other track-bound vehicles operating in the system) or for increased safety distances to be observed ahead of danger points.

According to the international standard IEC 61508 or, specifically for the railroad sector, according to the European standard EN 50129, four different safety integrity levels (SIL) or safety requirement levels are defined for safety functions. According to this classification, safety integrity level 4 represents the highest and safety integrity level 1 the lowest level of safety integrity. The respective safety integrity level influences the confidence interval of a measurement value to the effect that the confidence interval is particularly large for a situation in which a high safety integrity level is to be fulfilled or provided on the part of the respective device. This results in constraints due to comparatively inaccurate measurement values and the comparatively wide confidence interval associated therewith, in particular for such systems which fulfill the highest safety integrity levels SIL4 or SIL3.

A device of the type cited in the introduction is known for example from the published unexamined German patent application DE 10 2005 046 456 A1. This describes a device in which sensor data of a plurality of sensors is merged and the location or the respective movement variable of the track-bound vehicle is determined taking into account the respective sensor quality.

SUMMARY OF THE INVENTION

The object underlying the present invention is to disclose a device for determining at least one measurement value related to a location and/or at least one movement variable of a track-bound vehicle, which device can be used in a flexible manner and at the same time reduces operational constraints due to imprecise measurement values and large confidence intervals associated therewith.

This object is achieved according to the invention for a device for determining at least one measurement value related to a location and/or at least one movement variable of a track-bound vehicle in that the device is embodied in such a way that a safety integrity level can be specified for it, and the device calculates a confidence interval that is dependent on the respective specified safety integrity level for the measurement value or at least one of the measurement values.

Within the scope of the present invention, the at least one movement variable may be in particular a distance traveled by the track-bound vehicle, a speed of the track-bound vehicle and/or an acceleration of the track-bound vehicle. The at least one measurement value can be the direct result of a measurement or also a value derived or calculated from one or more corresponding measurements.

The device according to the invention is embodied in such a way that it can be assigned a predefinable safety integrity level. This means that the device according to the invention, in contradistinction to corresponding known prior art devices, can apply or take as a basis different safety integrity levels when determining measurement values of the location and/or the at least one movement variable of the track-bound vehicle. Accordingly, the safety integrity level is not permanently predetermined, but can be specified in a flexible manner. The device calculates a corresponding confidence interval for the respective measurement value as a function of the respective specified safety integrity level. In the event that a lower safety integrity level is specified for the device, a smaller confidence interval is therefore calculated by it than in the case where it is prescribed a higher safety integrity level.

The device according to the invention has the advantage that it is not bound to one safety integrity level. Instead, the same device can be used for implementing different safety integrity levels. In order to avoid misunderstandings, it should be pointed out at this juncture that a safety integrity level specified for the device will usually have an impact exclusively on the calculation of the respective confidence interval. This means that a device that is intended to fulfill the highest safety integrity level SIL4, for example, should essentially be implemented in terms of its hardware and also, where applicable, its software in such a way that said safety integrity level is achieved or can be achieved. This can include for example using a computer that is failsafe in respect of signaling functions, as well as developing the software in accordance with the regulations that are to be applied. Even if the device according to the invention may therefore be to that effect essentially SIL4-capable, for example, it is characterized specifically in that it is able, in relation to the measurement variables provided by it, to calculate the confidence intervals of the measurement values in accordance with different safety integrity levels. In this case the size of the respective confidence interval is dependent in particular on the confidence level on which the respective safety integrity level is based. Accordingly, at a confidence level of 95%, for example, a confidence interval is significantly smaller than in the case of a confidence level of 99.9999%.

The device according to the invention will usually be arranged onboard the vehicle or be provided for onboard deployment in the vehicle. Depending on the respective implementation, however, the device may in certain cases also comprise trackside components. This means in particular that in principle the confidence interval dependent on the respective specified safety integrity level can be calculated both onboard the vehicle and at the track side.

It should be pointed out that the device according to the invention is preferably implemented to be failsafe in respect of signaling functions. This means that it is guaranteed by means of appropriate measures—known per se to the person skilled in the railroad signal engineering art—that the device will satisfy the particularly high safety requirements of rail operation according to the relevant regulations prescribed by the respective regulatory authority. A corresponding failsafe implementation in respect of signaling functions will in this case generally be beneficial or necessary in particular in relation to the specification of the safety integrity level as well as to the calculation of the confidence interval that is dependent on the respective specified safety integrity level.

According to a particularly preferred embodiment variant, the device according to the invention is embodied in such a way that the safety integrity level can be specified for it by hardware and/or software means. A hardware-based specification of the safety integrity level can in this case be realized for example by means of a corresponding hardware coding of the device that is preferably failsafe in respect of signaling functions. In addition or alternatively hereto, the safety integrity level for the device may also have been or be specified in software, for instance in the form of a configuration process that is preferably embodied as failsafe in respect of signaling functions.

Preferably, the device according to the invention can also be developed in such a way that the safety integrity level can be specified for the device by means of a corresponding configuration, parameterization or setting. A specification of the safety integrity level for the device by means of a corresponding configuration, parameterization or setting is advantageous to the effect that by this means the desired or required safety integrity level in a given case can be set in a particularly simple and flexible manner. At the same time the configuration, parameterization or setting can advantageously be accomplished in particular on a software basis. This can happen for example by means of a corresponding configuration parameter, different safety integrity levels being used or applied by the device as a function of the value of the configuration parameter.

According to a further particularly preferred embodiment variant of the device according to the invention, the safety integrity level can also be specified for the device by means of a control device connected to the device for communication purposes. This offers the advantage that the control device in question can itself select or specify the respective safety integrity level. Preferably, the communications-oriented connection is in this case also implemented as failsafe in respect of signaling functions.

Preferably, the device according to the invention can also be embodied in such a way that the safety integrity level for the device can be specified dynamically during the ongoing operation of the device. This is advantageous since a dynamic specification of the safety integrity level during the ongoing operation of the device enables a flexible switchover between different safety integrity levels. Thus, this produces in particular the possibility of a specification of the safety integrity level that is dynamically aligned to operation and the operational constraints associated therewith in each case.

According to a further particularly preferred embodiment variant of the device according to the invention, the safety integrity level can be specified for the device on an application-dependent and/or situation-dependent basis. By this means it is advantageously made possible for example for applications or functions that have high safety requirements to expect or operate with a conservative, i.e. large, confidence interval. A corresponding function can be for example a danger point protection having safety integrity level SIL4. On the other hand, applications or functions for which a smaller safety integrity level is sufficient, i.e. for example a passenger boarding and alighting process or a passenger evacuation, can expect or operate with a smaller confidence interval and consequently achieve an improved accuracy in line with the respective safety integrity level. This offers in particular the advantage that operational constraints due to a large or too broadly estimated confidence interval, for instance in the form of a speed reduction, are minimized. Alternatively or in addition to taking into account the type of the respective application, the specification of the respective safety integrity level of the device can also be determined as a function of the respective situation, i.e. as a function of the respective actual operational conditions.

Preferably, the device according to the invention can also be developed to output the at least one measurement value and the confidence interval calculated for this to a control device of a train control system. By this means it is advantageously made possible for the cited variables to be used by the control device of the train control systems for the control or protection of the track-bound vehicle.

The invention further comprises a train control system having at least one device according to the invention or at least one device according to one of the previously described preferred developments of the device according to the invention.

The present invention further relates to a method for operating a device for determining at least one measurement value related to a location and/or at least one movement variable of a track-bound vehicle.

With regard to the method, the object underlying the present invention is to disclose a method for operating a device for determining at least one measurement value related to a location and/or at least one movement variable of a track-bound vehicle which can be used in a particularly flexible manner and at the same time reduces operational constraints due to imprecise measurement values and large confidence intervals associated therewith.

This object is achieved according to the invention by means of a method for operating a device for determining at least one measurement value related to a location and/or at least one movement variable of a track-bound vehicle, wherein a safety integrity level is specified for the device and a confidence interval dependent on the respective specified safety integrity level is calculated by the device for the measurement value or at least one of the measurement values.

The advantages of the method according to the invention correspond to those of the device according to the invention, such that in this regard reference is made to the corresponding aforementioned statements. The same applies with regard to the below-cited preferred developments of the method according to the invention in relation to the respective corresponding development of the device according to the invention, such that in this regard also reference is made to the aforementioned corresponding explanations.

According to a preferred development of the method according to the invention, the safety integrity level is specified for the device by hardware and/or software means.

Advantageously, the method according to the invention can also be embodied in such a way that the safety integrity level is specified for the device by means of a corresponding configuration, parameterization or setting.

According to a further particularly preferred embodiment variant of the method according to the invention, the safety integrity level is specified for the device by means of a control device connected to the device for communication purposes.

The method according to the invention can also be developed in such a way that the safety integrity level is specified for the device dynamically during the ongoing operation of the device.

According to a preferred development of the method according to the invention, the safety integrity level is specified for the device in an application-dependent and/or situation-dependent manner.

Preferably, the method according to the invention can also be embodied in such a way that the at least one measurement value and the confidence interval calculated for this are output by the device to a control device of a train control system.

BRIEF DESCRIPTION OF THE DRAWING

The invention is explained in more detail below with reference to exemplary embodiments. For this purpose, the FIGURE is a schematic drawing showing a track-bound vehicle comprising an exemplary embodiment of the device according to the invention.

DESCRIPTION OF THE INVENTION

In the FIGURE there can be seen a track-bound vehicle 10 in the form of a rail vehicle. Alternatively hereto, the track-bound vehicle 10 could also be for example a track-guided vehicle with rubber tires or a magnetic levitation train. The track-bound vehicle 10 moves along a track or track section 100. In order to control and protect the track-bound vehicle 10, accurate information is required, in particular in relation to the respective location and the respective speed of the track-bound vehicle 10. In this case the location can be specified for example as an absolute value or as a distance or section of track traveled relative to a reference point. It is furthermore possible, in addition or alternatively to the cited movement variables, also to measure or determine the acceleration of the track-bound vehicle as a movement variable and use the same for controlling the track-bound vehicle 10.

The track-bound vehicle 10 has a device 20, which may also be referred to as an odometry device. The device 20 comprises a computer or odometry computer 30 which is embodied as failsafe in respect of signaling functions. A first sensor 40, which can be for example a wheel impulse generator or a radar device, is connected to the computer 30 for communication purposes. In addition, the computer 30 is also connected for communication purposes to a second sensor 50, which can serve for example for satellite-based position determination, for example by means of GPS, and to that end is connected to an antenna 60. Alternatively or in addition to the sensors 40 and 50 cited by way of example, the device 20 could also comprise arbitrary other sensors that are known per se.

According to the illustration in the FIGURE, the computer 30 of the device 20 is additionally connected to a memory device 70. The latter comprises data and software programs required for operation of the device 20, i.e. for example control software, an electronic route map and/or configuration parameters. In this connection it should be explicitly pointed out that the FIGURE merely shows a schematic representation. This means that further components known per se are not shown for clarity of illustration reasons, and that the device 20 may also be constructed differently. Thus, for example, the memory device 70 may alternatively consist of a plurality of separate memory devices. Furthermore, the computer 30 and the memory device 70 may of course also be embodied in the form of a common component.

The computer 30 of the device 20 is furthermore connected to a control device 80 of a train control or train protection system. In this regard, the corresponding train control system may be any system used for commuter and mainline passenger transportation. It may be stated by way of example that the control device 80 may be a computer or European vital computer unit of the European Train Control System (ETCS) or also an onboard computer unit of a communications-based train control system (CBTC) used in suburban commuter rail systems.

Regardless of the type of the respective train control or train protection system, the device 20 or, in the illustrated exemplary embodiment, the computer 30 of the same provides the control device 80 with measurement values that relate to a location and/or at least one movement variable of the track-bound vehicle 20. Taking into account the measurement values provided on the part of the device 20, the control computer 80 performs the control and protection of the track-bound vehicle 10, where appropriate in cooperation with further onboard and/or trackside components. In this case the safety integrity level of the train control system, i.e. SIL4, for example, must also be ensured or guaranteed for the eventuality that the measurement values or data provided by the device 20 reveal a comparatively large inaccuracy. In order to enable the respective accuracy to be taken into account by the train control or train protection system, the measurement values in this case each possess an accuracy or inaccuracy indicator in the form of a confidence interval. Here, the confidence interval indicates the precision of the position estimation of the respective measurement variable, a confidence level being taken as a basis in each case. If the measurement values provided on the part of the device 20 demonstrate a comparatively large inaccuracy, this now leads to the situation whereby the confidence interval is increased in size accordingly, with the result that the performance of the train control system may be subject to constraints. This applies in particular in relation to a possible reduction in speed of the track-bound vehicle 10 or a setting of greater safety distances ahead of danger points.

With known prior art devices in the form of corresponding odometry equipment, the relationship between the safety integrity level and the respective confidence interval of specific measurement values is defined as invariable referred to a fixed safety integrity level. Said fixed safety integrity level is often or usually the highest safety integrity level SIL4. This means that corresponding odometry devices are configured in such a way that even in the case of sensor inaccuracies the fixed safety integrity level specified is maintained by adjustment of the confidence interval. The respective device is therefore developed specially for the respective safety integrity level, with the result that the device is specific to said safety integrity level, i.e. SIL2 or SIL4, for example.

The device 20 is now characterized in that a safety integrity level can be specified for it. In this case the corresponding specification of the safety integrity level can be accomplished using hardware or software means, in particular by means of a corresponding configuration, parameterization or setting. It is thus conceivable for example that the respective safety integrity level can be specified by means of a configuration parameter stored in the memory device 70, in which case a corresponding specification can be achieved for example by means of a corresponding failsafe signaling-related input or selection on a screen. In addition or alternatively hereto, it is also possible for the safety integrity level to be specified for the device 20 by the control device 80 connected for communication purposes to the device 20 or to be selected by said control device 80. In this case a corresponding specification can be either static, i.e. defined once only prior to the device 20 being put into operation, for example, or be input dynamically during the ongoing operation of the device 20 and of the track-bound vehicle 10. It is possible in this case for example that the safety integrity level is specified for the device 20 by the control device 80 as a function of the respective application and/or the respective situation.

Irrespective of the form or manner in which the safety integrity level is specified for the device 20, the device 20 is embodied in such a way that it calculates at least one confidence interval dependent on the respective specified safety integrity level for the measurement value or for at least one of the measurement values. Preferably, a corresponding confidence interval is calculated in this case for each of the measurement values.

The device 20 therefore has the capability to operate with a plurality of different safety integrity levels and to calculate confidence intervals that are dependent on the respective specified safety integrity level for the determined measurement values. The safety integrity levels are therefore scalable to the effect that a very conservative confidence interval which expresses a comparatively large inaccuracy is estimated in the case of a high safety integrity level, e.g. SIL4, and leads to comparatively great operational constraints, whereas a smaller confidence interval is calculated in the case of a smaller safety integrity level, e.g. SIL2.

The device 20 or the computer 30 of the same is embodied to transmit the at least one measurement value and the at least one confidence interval calculated for the measurement value or for at least one of the measurement values to the control device 80 of the train control system. By this means it is therefore made possible for the control device 80 of the train control system to take the location and/or the respective movement variable of the track-bound vehicle 10 into account during the control of the track-bound vehicle 20. In this case the flexible specification of the respective safety integrity level permits a flexible modeling of odometry-dependent functions in train control systems. This means that functions having a high safety integrity level, i.e. danger point protection, for example, can expect a conservative (large) confidence interval, whereas functions having smaller safety integrity levels, i.e. e.g. a passenger boarding and alighting process or an evacuation, can expect a smaller or minimized confidence interval. In the latter case, operational constraints due to a high confidence interval are consequently reduced or minimized.

An odometry architecture that is flexible or scalable in relation to the confidence interval calculated in each case is therefore realized by means of the device 20. As a result, it becomes possible in particular to optimize or adapt odometry-dependent functions in train protection systems specifically for the respective safety integrity level. Thus, as already mentioned, a passenger boarding and alighting process classified according to SIL2, for example, can be handled with a small confidence interval. The boarding/alighting of passengers is reliably facilitated as a result, since the so-called "stopping window" is robustly met. On the other hand, in the case of a safety integrity level of SIL4, a greater confidence interval would be necessary, as a result of which the reliable meeting of the "stopping window" may be subject to constraints.

According to the aforementioned explanations in connection with the described exemplary embodiments, the device according to the invention and the method according to the invention in the end enable a balance to be achieved between the respective safety requirements (defined by the respective safety integrity level) and the respective confidence interval of provided measurement values (or, as the case may be, the associated confidence level, i.e. ultimately the baseline or required accuracy).

The invention claimed is:

1. A device for determining at least two measurement values related to a location and/or at least one movement variable of a track-bound vehicle, the device being configured for implementing different safety integrity levels;

being configured to fulfill a highest safety integrity level of said different safety integrity levels in terms of hardware and software so that the highest safety integrity level can be achieved;

being configured such that one safety integrity level of said different safety integrity levels can be specified for each of the measurement values respectively, and applying different safety integrity levels when determining the measurement values; and being configured to calculate a confidence interval that is dependent on a respective said specified safety integrity level for at least one measurement value or for each of the measurement values.

2. The device according to claim 1, wherein the device is configured to enable the safety integrity level to be specified by hardware and/or software.

3. The device according to claim 1, wherein the safety integrity level is specified for the device by way of a corresponding configuration, parameterization, or setting.

4. The device according to claim 1, which comprises a controller connected for communication with the device and for specifying the safety integrity level for the device.

5. The device according to claim 1, wherein the safety integrity level can be specified for the device dynamically during an ongoing operation of the device.

6. The device according to claim 5, wherein the safety integrity level is to be specified for the device on an application-dependent and/or a situation-dependent basis.

7. The device according to claim 1, wherein the device is configured to output the at least one measurement value and the confidence interval calculated for the device to a controller of a train control system.

8. A train control system, comprising at least one device according to claim 1.

9. A method of operating a device for determining at least two measurement values related to a location and/or at least one movement variable of a track-bound vehicle, the method comprising:

providing the device with a capability to implement different safety integrity levels and with the capability to fulfill a highest safety integrity level of the different safety integrity levels in terms of hardware and software so that the highest safety integrity level can be achieved;

specifying one of the safety integrity levels for each of the measurement values respectively, and applying different safety integrity levels when determining the measurement values; and calculating a confidence interval dependent on a respective specified safety integrity level by the device for a measurement value or for each of the measurement values.

10. The method according to claim 9, which comprises specifying the safety integrity level for the device by way of hardware and/or software.

11. The method according to claim 9, which comprises specifying the safety integrity level for the device by way of a corresponding configuration, parameterization, or setting.

12. The method according to claim 9, which comprises specifying the safety integrity level for the device by a control device connected to the device for communication purposes.

13. The method according to claim 9, which comprises specifying the safety integrity level for the device dynamically during an ongoing operation of the device.

14. The method according to claim 13, which comprises specifying the safety integrity level for the device in an application-dependent and/or situation-dependent manner.

15. The method according to claim 9, which comprises outputting the at least one measurement value and the corresponding confidence interval thus calculated from the device to a control device of a train control system.

* * * * *